United States Patent [19]

Miskech

[11] 4,042,416

[45] Aug. 16, 1977

[54] METHOD FOR TREATING CUP-SHAPED WORKPIECES

[75] Inventor: Peter Miskech, Warren, Mich.

[73] Assignee: Oxy Metal Industries Corporation, Warren, Mich.

[21] Appl. No.: 667,574

[22] Filed: Mar. 17, 1976

Related U.S. Application Data

[62] Division of Ser. No. 572,166, April 28, 1975, Pat. No. 3,969,136.

[51] Int. Cl.[2] ..... B08B 3/02; B08B 7/04

[52] U.S. Cl. ..... 134/10; 134/22 R; 134/30; 134/34; 134/37

[58] Field of Search ..... 134/10, 22 R, 24, 25 R, 134/30, 34, 37, 25 A, 50, 54, 95, 152, 154, 168 R, 170, 171

[56] References Cited

U.S. PATENT DOCUMENTS

| | | | |
|---|---|---|---|
| 1,799,525 | 4/1931 | Morgan | 134/170 X |
| 3,043,318 | 7/1962 | Hi | 134/170 X |
| 3,088,473 | 5/1963 | Rogge | 134/170 X |
| 3,868,960 | 3/1975 | Cove et al. | 134/10 X |

*Primary Examiner*—S. Leon Bashore

*Assistant Examiner*—Richard V. Fisher

*Attorney, Agent, or Firm*—Harness, Dickey & Pierce

[57] ABSTRACT

A method for treating cup-shaped workpieces in which the workpieces are positioned within a shape-conforming chamber formed with an outlet port in the base thereof and a conforming nozzle is positioned within the interior of the workpiece in close clearance-spaced relationship. The nozzle is provided with an axial port for discharging a high-pressure treating fluid against the central portion of the interior bottom surface of the workpiece, causing a high-speed radial outward flow therealong and thence axially outwardly along the interior wall surfaces of the workpiece. Upon reaching the open end of the workpiece, the direction of flow is reversed and is directed axially along the exterior wall surface of the workpiece, and upon passing the bottom edge thereof, the fluid is deflected in impinging relationship against the outer bottom surface, whereafter it is discharged through the outlet port and is recovered for reuse. The method further include the steps of discharging a plurality of individual treating fluids in sequentially-phased relationship separated by intervening purging steps so as to effect a plural treatment of the surfaces of cup-shaped workpieces.

4 Claims, 11 Drawing Figures

METHOD FOR TREATING CUP-SHAPED WORKPIECES

This is a division of application Ser. No. 572,166, filed Apr. 28, 1975, now U.S. Pat. No. 3,969,136 .

BACKGROUND OF THE INVENTION

The present invention is particularly applicable but not necessarily restricted to an apparatus and method for processing cup-shaped workpieces, such as containers employed for packaging various products such as foodstuffs, including beverages, and other products such as paints, deordorants, insecticides, etc., which are dispensed in pressurized aerosol-type containers. High-speed, modern, automatic machines have been developed for forming such containers in any one of a variety of materials including glass, plastic materials, metal and metal alloys such as, for example, tin-plated steel, plastic-lined steel, aluminum and alloys thereof.

It is customary in the packaging art to subject the preliminarily-formed containers to a series of treatments preparatory to the filling operation in which surface contaminants, such as die lubricants and other films deposited during the fabrication process, are removed to render the containers of the requisite cleanliness, as well as to impart selected surface treatments to the containers in order to increase their corrosion resistance, to provide a desired decorative appearance and to render the container surface more receptive to a final finish coating. It is necessary to effect such plural treatments of the containers at high speed corresponding to the rate at which the container bodies are fabricated and this has occasioned problems in the processing of cup-shaped containers because of their tendency to entrap a treating solution from one treating step causing a carry-over thereof and a contamination of the treating solutions of succeeding treating steps. Another problem associated with high-speed processing of containers has been the tendency of a stagnant liquid film to form adjacent to the workpiece surface which becomes depleted of the active agents therein during the course of a treatment, thereby reducing the speed and efficiency of the treating cycle.

The apparatus and method of the present invention overcomes the problems and disadvantages associated with prior art techniques by substantially eliminating the formation of stagnant surface films on the workpiece surface, thereby optimizing treating efficiency and further assuring a substantially complete removal of residual treating liquid from the surfaces of the container before initiation of the next treating cycle.

SUMMARY OF THE INVENTION

The benefits and advantages of the present invention in accordance with its apparatus aspects is achieved by a machine including a framework having mounted thereon a plurality of housings, each defining an individual chamber adapted to removably receive a cup-shaped workpiece in spaced clearance relationship with respect to the peripheral surfaces of the workpiece so as to provide a fluid flow path. Each chamber is provided with a shape-conforming nozzle adapted to be disposed in spaced clearance relationship with respect to the interior surfaces of the cup-shaped workpiece and which is formed with an axial port for discharging a high-pressure treating fluid against the central portion of the inner bottom surface of the workpiece in a manner to effect a high-speed radial outward flow of the treating fluid across the surface, effecting intimate contact therewith. The fluid thereafter passes axially along the inner surfaces of the workpiece wall outwardly beyond the open end of the workpiece, whereafter it is turned 180° and passes axially along the flow path defined by the space between the periphery of the workpiece and the chamber surface beyond the closed end of the workpiece. A deflector is provided adjacent to the end of the chamber to effect a deflection of the treating fluid so as to impinge against the outside bottom surface of the workpiece, effecting intimate fluid contact therewith. The base of the chamber is formed with a discharge port through which the treating fluid is discharged from the chamber and is recovered in a receptacle and is recycled for reuse. The housing defining the chamber is of a sectionalized construction including a movable section which is positionable in a closed position corresponding to the operating position, and an open position to facilitate loading and unloading of the workpieces.

In accordance with a preferred embodiment, a plurality of housings are mounted on a rotary turntable and an opening and closing of the chambers is achieved in response to cam-actuated means operable in response to the rotation of the turntable in coordinated relationship with suitable loading and unloading devices disposed at the inlet end and outlet end of the machine. A ported valve plate and manifold system is operable to supply a plurality of individual treating fluids to the nozzle of each treating chamber in a preselected timed sequence in response to the rotary movement of the turntable, providing thereby a sequentially-phased treating cycle.

In its method aspects, the present invention is directed to a process for performing a fluid treating operation on the surfaces of cup-shaped workpieces, whereby each workpiece is enclosed within a conforming chamber disposed in spaced relationship from the periphery thereof and a conforming nozzle is inserted within the interior of the workpiece, through which a high-pressure fluid is discharged against the interior of the workpiece in a manner to effect a high-speed flow pattern across the bottom and interior and exterior wall surfaces of the workpiece, minimizing the formation of any stagnant barrier films, and thereby substantially increasing the efficiency and speed of treatment of the workpieces. Each liquid treating step is separated by an intervening purging step employing high-pressure gas, such as air, to effect a substantially complete removal of any entrapped treating liquid before initiation of the next liquid treating cycle.

Further benefits and advantages of the present invention will become apparent upon a reading of the description of the preferred embodiments taken in conjunction with the accompanying drawings.

DESCRIPTION OF THE PREFERRED EMBODIMENTS

Figure 1:
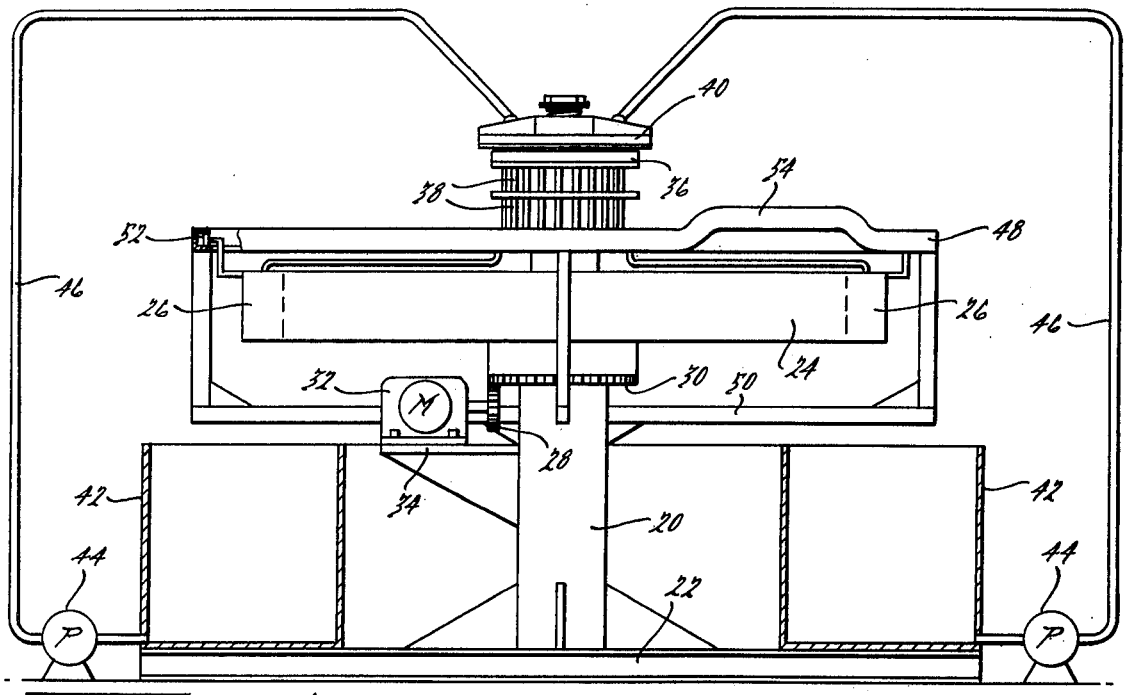
FIG. 1 is a side elevational view, partly in section and partly schematic, illustrating a rotary liquid processing machine constructed in accordance with the preferred embodiments of the present invention.
Figure 2:
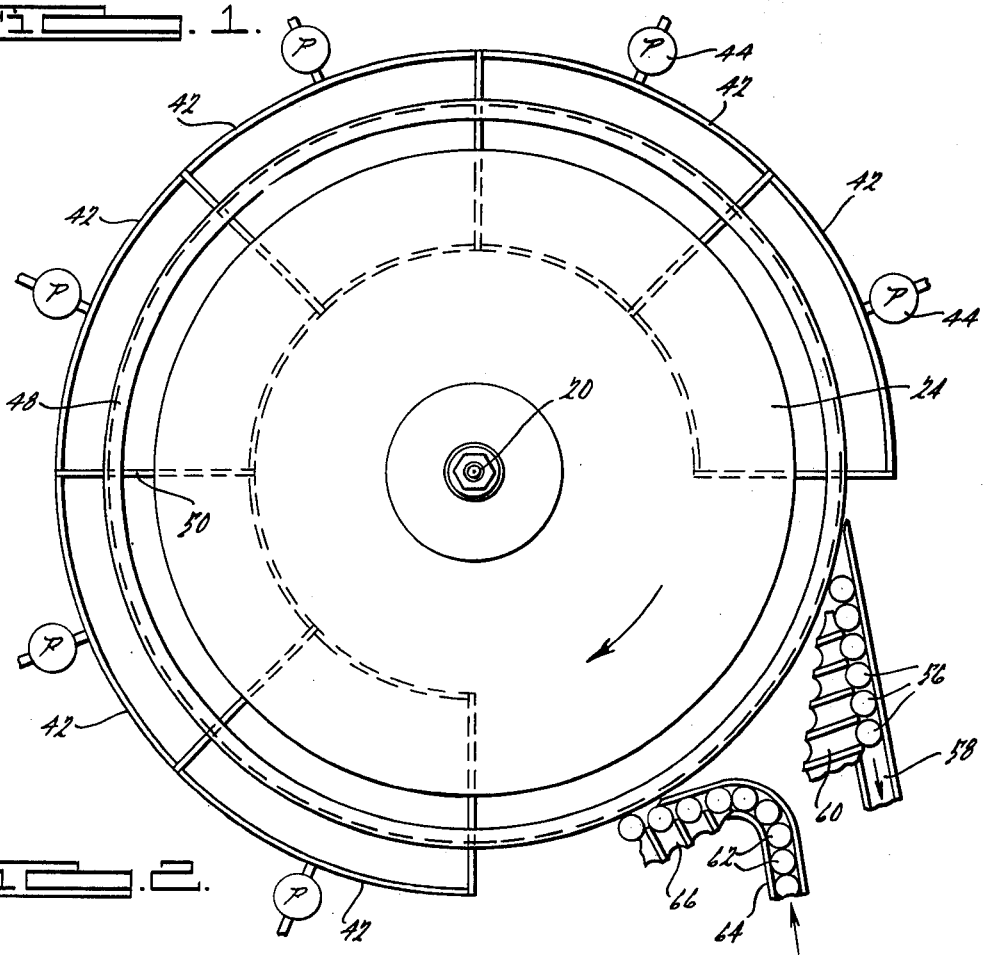
FIG. 2 is a plan view, partly schematic, of the machine shown in FIG. 1.

Referring now in detail to the drawings, and as may be best seen in FIGS. 1 and 2, the apparatus of the present invention comprises a framework including a central pedestal 20 having a base 22 on which a rotor 24 is rotatably mounted and is formed with a plurality of housings 26 disposed at circumferentially-spaced intervals around the periphery thereof. The rotor 24 is driven by means of a pinion gear 28 disposed in meshing relationship with a ring gear 30 mounted on the underside of the rotor. The pinion gear is drivingly coupled to a speed reducer motor unit 32 supported on a platform 34 affixed to the pedestal 20.

A manifold assembly 36, incorporating a plurality of supply conduits 38, is rotatably mounted on the pedestal above the rotor and the supply conduits 38 are individually connected to a respective nozzle disposed within each housing 26. A valve assembly 40 is stationarily supported above the manifold assembly 36 for selectively supplying a treating fluid to the conduits of the manifold assembly in relationship to the angular disposition of the rotor. A plurality of tanks 42 are disposed below the rotor at circumferentially-spaced intervals to receive treating fluid discharged from the individual housings as they travel in an arcuate path above the open ends of the tanks. Each tank is provided with a pump 44, as schematically shown in FIGS. 1 and 2, having its outlet end connected to a flexible supply pipe 46 for supplying the pressurized treating fluid to appropriate arcuate manifold segments above the valve assembly 40.

A circular channel-shaped cam track 48 extends around the upper periphery of the rotor and is stationarily supported by means of a plurality of L-shaped braces 50 connected to the stationary lower portion of the pedestal 20. A cam follower or roller 52 connected to a movable section of each housing is positioned within the cam track 48 and is operable for opening and closing the housing in response to the rotary movement of the rotor. For this purpose, the cam track 48 is provided with an elevated section, indicated at 54 in FIG. 1, positioned adjacent to the load and unload section of the machine to effect an opening of the housing in a manner subsequently to be described in greater detail, enabling extraction and reloading of containers into the individual housings. An automatic loading and unloading of the workpiece containers is achieved, as schematically shown in FIG. 2, by a tapered screw-type conveyor which operates in timed sequence with the rotation of the rotor. In accordance with the foregoing arrangement, processed containers, indicated a 56, are removed along an unloading chute 58 by a screw conveyor 60; while unprocessed containers 62 move along a loading chute 64 by means of a screw conveyor 66 for sequential loading into the unloaded housings.

Referring now to FIGS. 3–8, a housing and nozzle assembly is shown constructed in accordance with one embodiment of the present invention in which the housing is comprised of a stationary semi-circular tubular section 68 and a vertically movable semicircular tubular section 70, which are interlockingly fitted adjacent their mating edges by cooperating keyways and slides 72, 74 providing relative guided movement, as well as for sealing the adjoining edges thereof. The stationary housing section 68 is rigidly supported at its base on a base plate 76 and at its upper end to a top plate 78 extending radially of the rotor.

Figure 5:
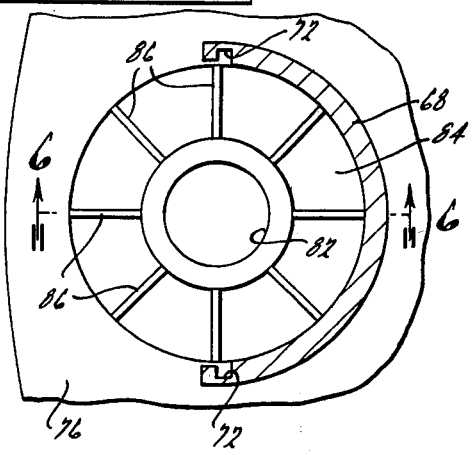
FIG. 5 is a transverse horizontal sectional view through the stationary housing section as shown in FIG. 3 and taken substantially along the line 5—5 thereof.
Figure 8:
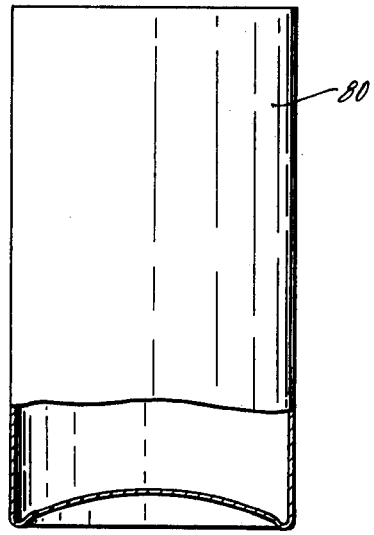
FIG. 8 is a side elevational view, partly in section, of a typical open-ended container which can be processed in accordance with the apparatus of the present invention.
Figure 7:
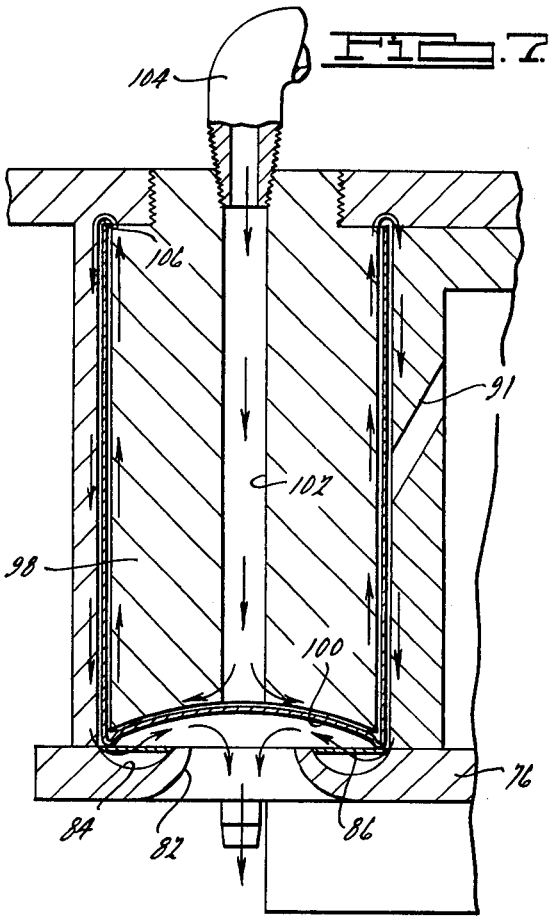
FIG. 7 is a fragmentary vertical sectional view through a housing and nozzle disposed in a closed position having a container positioned therein for undergoing a fluid treatment.

The movable and stationary housing sections, when disposed in a closed position as shown in FIG. 7 and in phantom in FIG. 5, define in internal chamber of a substantially circular cross sectional configuration and of a height corresponding substantially to the height of a cup-shaped workpiece, such as a container 80 illustrated in FIG. 8. The container 80 is exemplary of a thin-walled aluminum can of the type currently employed for packaging various beverages and is formed with substantially straight side walls and a dished or concave bottom integrally formed with the side walls. The container is trimmed at its upper end after the initial forming operation to provide a square open end which subsequently is sealed with a top during the container filling operation. The diameter of the circular cylindrical chamber defined by the movable and stationary housing sections is slightly in excess of the exterior diameter of the container, providing a radial clearance of a magnitude to produce a high-speed flow pattern across the surface of the container minimizing the formation of any stagnant barrier films thereby substantially increasing the speed and efficiency of treatment which may typically be in the order of about 0.010 to about 0.040 inch defining an annular space through which the high-pressure fluid is adapted to flow.

Figure 6:
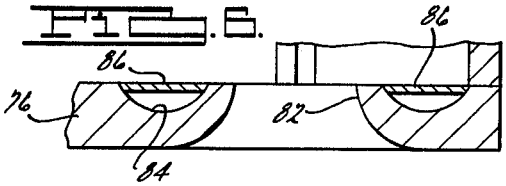
FIG. 6 is a transverse vertical sectional view through the base of the housing as shown in FIG. 5 and taken substantially along the line 6—6 thereof.

The base plate 76 is formed with a discharge port 82 disposed in axial central alignment with the center of the chamber and is further formed with an annular arcuate deflection surface, indicated at 84, as best seen in FIG. 6, for deflecting the treating fluid upwardly against the outer surface of the container bottom as shown in FIG. 7. A plurality of radially extending ribs 86 are disposed so as to bridge the curvature of the deflection surface 84, providing a support for the edge of the container bottom.

Figure 3:
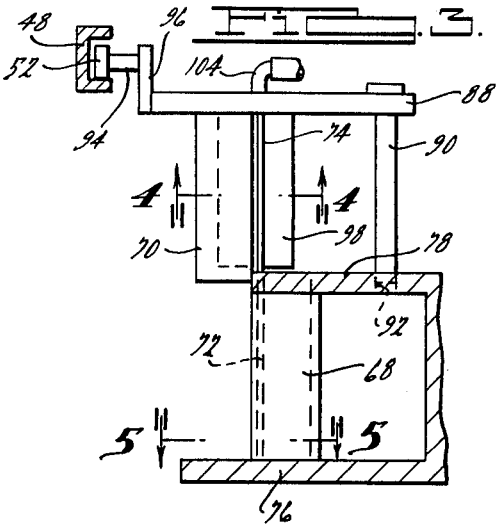
FIG. 3 is a magnified, fragmentary side elevational view, partly in section, of a housing and nozzle assembly disposed in an open position to enable a loading and unloading of a cup-shaped workpiece.
Figure 4:
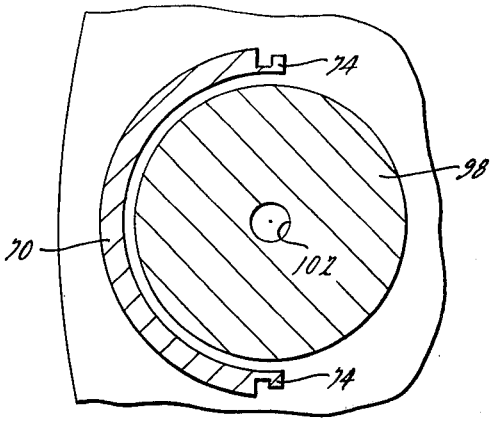
FIG. 4 is a transverse sectional view through the movable housing section as shown in FIG. 3 and taken substantially along the line 4—4 thereof.

The movable housing section 70 is affixed at its upper end to a plate 88, to the inward portion of which a guide rod 90 is secured, which in turn is guidably and slidably disposed in a bore 92 provided in the top plate 78, as best seen in FIG. 3. The cam follower or roller 52 is affixed to a shaft 94 supported by a bracket 92 secured to the peripheral edge of the plate 88. Accordingly, vertical guided movement of the plate 88 and the movable housing section is provided by the guide rod 90 and slides 74, preventing skewing of the assembly during relative vertical movement. The cam follower 52 is disposed in the U-shaped cam track 48 in a manner as previously described in connection with FIG. 1.

In accordance with a preferred embodiment, the stationary section 68 of the housing is formed with an angularly-disposed port 91 which is adapted to be connected to a source of vacuum when the rotor is disposed at the load and unload station to effect a retention of the container in position when the movable section of the housing is in the open position. This counteracts centrifugal force, preventing inadvertent discharge of the container. It is also contemplated that the port 91 can be connected to a source of pressurized air at the unload station to facilitate ejection of the container to the unload mechanism.

A cylindrical shape-conforming nozzle 98 is affixed at its upper end to the plate 88 in concentric relationship with respect to the movable and stationary housing sections and is of a peripheral diameter less than the internal diameter of the container so as to provide an annular clearance which typically may range from about 0.010 to about 0.040 inch, defining an annular flow path for the treating fluid between the periphery of the nozzle and the internal surfaces of the container to provide the desired high-speed flow pattern. The nozzle is formed with a correspondingly contoured concaved end surface 100 so as to conformingly overlie the inner surface of the container bottom, as best seen in FIG. 7, in close clearance-spaced relationship. The nozzle 98 is formed with an axially extending port 102 opening at substantially the center of its concave end surface and is coupled to a tubular fitting 104 at its upper end, which in turn is connected to an individual supply conduit 38 connected to the manifold assembly 36 as previously described in connection with FIG. 1.

In accordance with the foregoing arrangement, when the housing is disposed in a closed position as shown in FIG. 7, a treating fluid travels downwardly through the axial port 102 and is discharged in impinging relationship against the central portion of the inner can bottom, and thereafter flows in a radial pattern outwardly and thence upwardly along the inner container surface until it passes the upper open edge thereof. A semi-circular annular groove 106 is formed in the plates adjacent to the upper end thereof for permitting the fluid to pass around the upper edge of the container and thence downwardly along the exterior surfaces of the container wall toward the container bottom. Upon passage beyond the lower edge of the container, the fluid stream is deflected by the deflection surface 84 upwardly in radial inward impinging relationship against the outer bottom surface of the container, whereafter it passes through the discharge port 82 and is received in one of the tanks 42 as shown in FIG. 1, over which the housing if positioned. The high velocity of the fluid passing through the narrow annular passageways between the housing and nozzle and container surfaces maintains the container in appropriately spaced centralized relationship and further prevents the formation of stagnant liquid films adjacent to the container surface which impedes rapid and efficient treatment thereof.

It will be apparent from the foregoing that a container, such as the can 80 shown in FIG. 8, can be subjected to a plural treatment during the course of its travel on the rotor during a complete revolution thereof. The can 80 is typical of those produced by deep drawing a blank of aluminum through a single or multiple-stage die-forming operation. As a result of the die-forming operation, the surfaces of the can are coated with various contaminating substances including die lubricants which first must be removed through an appropriate cleaning operation, whereafter the cleaned can can be subjected to a chemical conversion type coating, such as a chromate coating, for example, so as to impart improved resistance against chemical attack, as well as providing an improved substrate for receiving supplemental decorative and/or protective coatings on the container surfaces.

A typical precleaning operation of aluminum cans may comprise one or a plurality of aqueous or organic cleaning solutions, such as, for example, an acid cleaner including phosphoric or sulfuric acid substances in combination with various surface active agents. Preferably, an alkaline cleaner is employed which normally comprises a mixture of alkali metal salts, such as sodium metal salts or carbonates, phosphates, polyphosphates and hydroxides which are usually employed in concentrations of about 0.5 to about 4 ounces per gallon and are adjusted so as to produce an aqueous cleaning solution having a pH ranging from about 9 up to about 11. It is usually preferred to employ two separate cleaning steps in order to not only effect a removal of contaminating substances from the container surfaces, but also any oxides present producing a mild surface etching of the container preparatory to the next treating step.

The first cleaning solution is introduced into the closed chamber as the housing passes over the upstream partition of a treating tank, whereby the cleaning solution is directly dishcharged and recovered in the tank for recirculation. Toward the downstream end of the cleaning tank, the valving arrangement effects stoppage of cleaner solution and high-pressure air is introduced into the housing to effect a substantially complete removal of any entrapped cleaning solution therein. This residual solution is also recovered in the tank. As the rotor continues to move, it passes over the upstream end of the next adjoining tank and the second cleaner solution is introduced to effect a second cleaning of the can surfaces in a manner as previously described.

At the completion of the precleaning and cleaning steps, it is usually preferred to subject the containers to a plural water rinse treatment, which may comprise a hot or cold water rinse so as to effect a substantially complete removal of all residual cleaning substances from the container surfaces. The plural rinse treatment is also carried out employing intervening air purging treatments to remove all residual entrapped water from the container surfaces.

Following the rinse treatment, the containers are subjected to a suitable chemical conversion coating liquid, such as, for example, an aqueous chromate coating solution of any of the types well known in the art. Typically, such a chromate coating solution may comprise an aqueous solution containing hexavalent chromium ions in concentrations normally ranging from about 0.2 up to about 10 grams per liter at a pH usually ranging from about 1 to about 3, and at a solution temperature of about 60° F to about 130° F. The application of the chromate solution to the cleaned and rinsed can surface effects the formation of an amorphous corrosion protective film of the desired thickness on the aluminum container surfaces, which is controlled by controlling the duration of the treatment cycle. The chromate coating not only provides corrosion protection of the aluminum substrate, but also provides a surface which is more receptive to organic finish coatings, such as decorative paints, subsequently to be applied to the can surface.

At the completion of the chromate solution treatment, it is conventional to effect a plural water rinsing of the container, which preferably comprises a first water rinse, followed by two deionized water rinse treatments, each having an intervening air purging to remove the residual entrapped water. At the completion of the last deionized rinse treatment, the air purging is carried out for a prolonged time period so as to effect a substantially complete drying of the can. It has been found, due to the high velocity of the air relative to the can surfaces, that adequate drying of the can can be achieved employing room temperature air applied for a period of only several seconds.

The diameter of the rotor and its speed of rotation are predetermined so as to accommodate the required number of housing and nozzle assemblies to provide the desired production capacity and treatment duration in accordance with the specific types and number of individual treating steps performed. Generally, rotors having a diameter of from about 10 to about 15 feet accommodating from about 100 to about 150 housing and nozzle assemblies rotating at a speed of about 2 to 6 rpm can be employed for processing containers through a typical chemical conversion coating process including a prior precleaning treatment at a rate upwards of 200 to as high as about 600 cans per minute.

Figure 9:
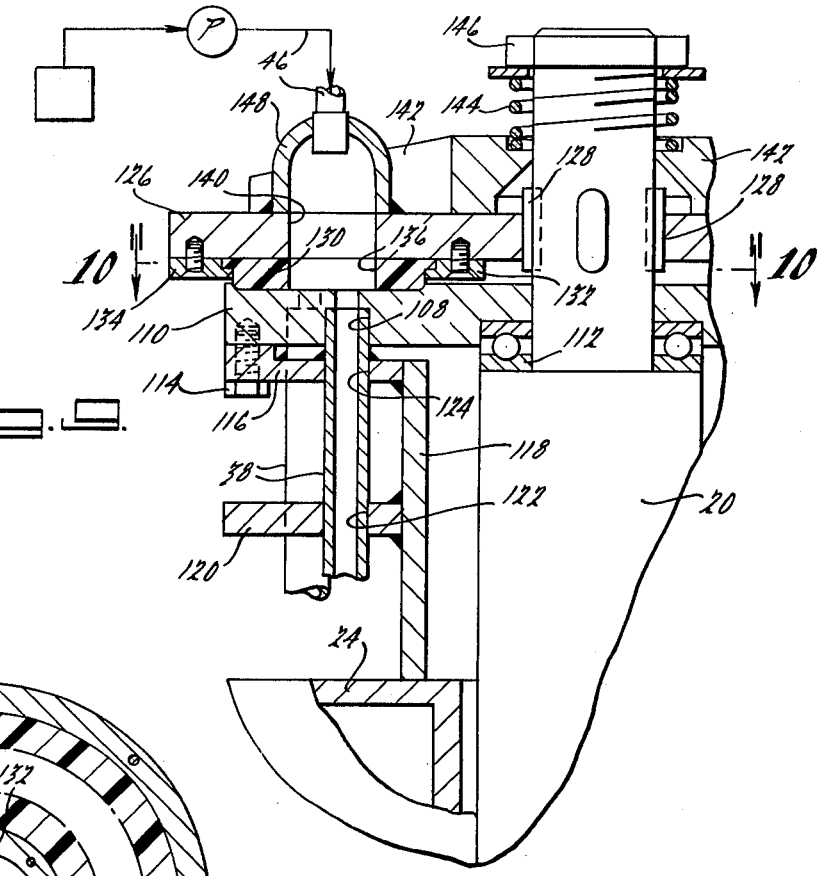
FIG. 9 is a fragmentary vertical sectional view of the ported plate and manifold arrangement mounted at the upper end of the machine as shown in FIG. 1.
Figure 10:
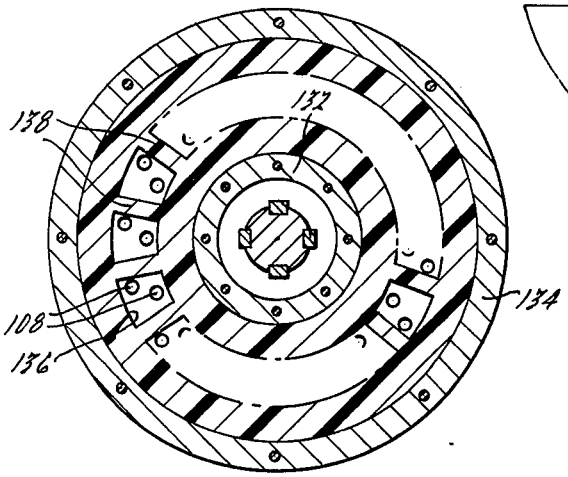
FIG. 10 is a plan view of the valve assembly shown in FIG. 9 and taken substantially along the line 10—10 thereof.

Referring now in detail to the valve and manifold arrangement as shown in FIGS. 9 and 10, the sequentially-phased supply of treating solutions, rinse solutions and purging or drying air is achieved in response to the rotation of the rotor, whereby the inlet ends of the supply conduit 38 are sequentially disposed in communication with a pressurized source of the appropriate treating fluid. As shown, the inlet ends of each supply conduit 38 are slidably disposed in ports 108 positioned in circumferentially-spaced relationship and extending axially through a rotary manifold plate 110 rotatably supported by a bearing 112 on the stationary upper portion of the pedestal 20. In the specific arrangement as shown in FIGS. 9 and 10, the ports in the manifold plate 110 are arranged on triangular centers providing two spaced circumferential rows which substantially correspond in number to the number of housings extending around the periphery of the rotor.

The lower outer periphery of the manifold plate is securely fastened such as by means of screws 114 to a radially extending flange 116 secured to its inner end to a tubular weldment 118, the base of which is affixed to the upper portion of the rotor 24. A second lower radially extending flange 120 is affixed to the tubular wledment and is formed with a plurality of bores 122 disposed in axial alignment with bores 124 in the upper flange 116 for slidably receiving and supporting the supply conduits 38, maintaining them in appropriate vertically oriented relationship.

A circular valve plate 126 is stationarily affixed, such as by means of keys 128, to the upper stationary end of the pedestal 20, to the underside of which a ported gasket 130 of a resilient sealing material is securely affixed by means of an inner retainer ring 132 and an outer retainer ring 134. The ported gasket 130 incorporates a plurality of circumferentially spaced trapezoidal or pie-shaped ports 136 at circumferentially-spaced intervals therearound at a location in line with the ports 108 in the manifold plate 110. The ports 136 are separated by radially extending ribs 138, which in combination with the annular inner and outer portions of the gasket effect a seal of the pressurized fluid supplied to each trapezoidal port. The valve plate 126 is provided with trapezoidal ports 140 disposed in registration with the ports 136 in the gasket.

Rigidification of the valve plate 126 is provided by a plurality of radially extending braces 142 secured to the upper surface of the valve plate and which in turn is spring-biased downwardly by means of a spring 144 extending around the upper portion of the pedestal and secured at its upper end by means of a nut 146. The biasing force provided by the spring 144 urges the underside of the resilient ported gasket into tight sealing relationship against the upper surface of the manifold plate 110.

A housing 148 is affixed to the upper portion of the valve plate 126 in registration with each trapezoidal port 140 which in turn is connected to the supply pipe 46 for supplying an appropriate fluid under pressure in a manner as previously described in connection with FIG. 1. It will be apparent from the foregoing arrangement that as the manifold plate rotates relative to the valve plate 126, as best seen in FIG. 10, the ports 108 sequentially are positioned in communication with the ports 136 of the gasket in response to angular movement thereof, effecting a sequentially-phased supply of treating fluid to the respective housing and nozzle assembly.

Figure 11:
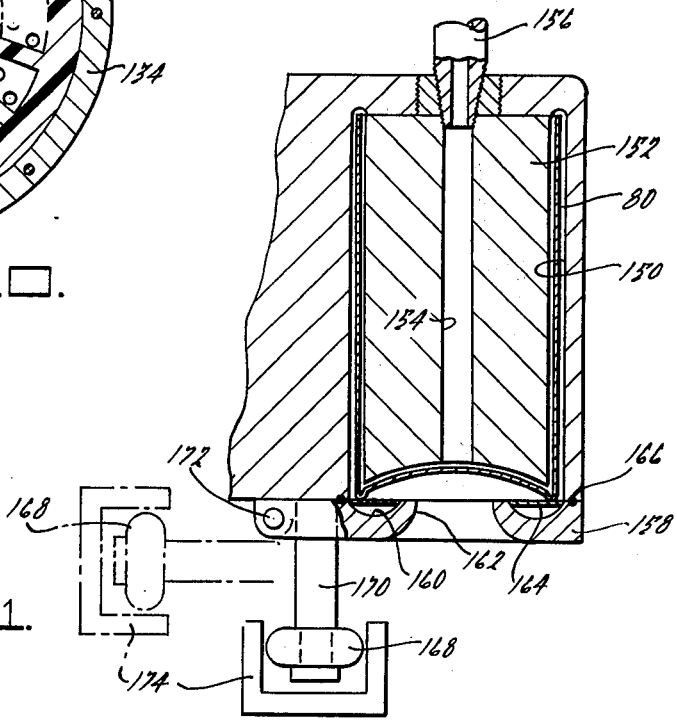
FIG. 11 is a fragmentary side elevational view, partly in section and partly in phantom, illustrating an alternative embodiment of a chamber and nozzle arrangement of the present invention.

An alternative satisfactory arrangement of a sectionalized housing and nozzle assembly is shown in FIG. 11 in which a circular cylindrical chamber 150 is formed in the periphery of the rotor for receiving the container 80 in spaced clearance relationship relative thereto. A conforming cylindrical nozzle 152 is threadably secured at its upper end into the upper flange defining the top of the chamber and is formed with an axial port 154 for receiving the pressurized treating fluid supplied through a supply conduit 156 connected to the upper end thereof. The base of the housing is defined by a hingedly mounted plate 158 incorporating a deflection surface 160, a discharge port 162 and a plurality of radially extending ribs 164 in accordance with the same general arrangement and for the same purposes as previously described in connection with FIGS. 5 and 6. A sealing of the bottom plate 158 to the upper housing is achieved by an O-ring seal 166 to prevent leakage of solution during a treating operation.

A selective opening and closing of the base plate 158 is achieved by a cam follower or roller 168 rotatably mounted on a shaft 170 affixed at its upper end to the plate 158 at a point spaced outwardly of the hinge 172. Movement of the base plate to and from a closed position, as shown in solid lines in FIG. 11, to an open position, as fragmentarily shown in phantom, is achieved by a U-shaped cam track 174 extending around the machine in the same manner as previously described in connection with the cam track 48.

Unloading and loading of the container 80 from the housing when in the open position is facilitated by introducing pressurized air into the axial port of the nozzle 152, effecting an ejection of a processed container and thereafter introducing a suction or a vacuum to the axial port facilitating inward movement of a cam to the position shown in FIG. 11 during a loading operation and a retention of the can in that position until the base plate is again closed. In other respects, the operation of the housing and nozzle assembly as shown in FIG. 11 is substantially identical to that previously described.

It is also contemplated that in lieu of employing single valve and manifold assembly for supplying the separate treating fluids through a common supply conduit 38, two or more separate valve assemblies and manifold assemblies can be employed for supplying an individual or selected combination of treating fluids through individual supply conduits to each nozzle. The use of plural valve assemblies still further minimizes contamination of succeeding solutions by any residual fluids remaining in the supply conduit connected to a nozzle. The use of a corresponding plurality of separate supply conduits to each nozzle necessitates the provision of suitable flow-check valves at thier common connection to the nozzle assembly. The flow-check valves, which may be in the form of a resilient diaphragm or ball-check valve, prevents a back-up flow of pressurized treating fluid being supplied by one conduit into the ends of the other conduits not then in use. In other respects, the operation of the plural valve assemblies and manifold assemblies is the same as that of the manifold assembly 36 and valve assembly 40 previously described.

While it will be apparent that the invention herein disclosed is well calculated to achieve the benefits and advantages set forth above, it will be appreciated that the invention is susceptible to modification, variation and change without departing from the spirit thereof.

What is claimed is:

1. A method of treating the surfaces of cup-shaped workpieces each comprising a cylindrical side wall closed at one of its ends by a bottom wall which comprises the steps of positioning a shape conforming nozzle within the interior of each workpiece in clearance-spaced relationship relative to the interior surface of the side wall and bottom wall thereof and enclosing the exterior of the workpiece within a chamber disposed in clearance-spaced relationship to the exterior surface of the side wall thereof in a manner to define in combination with the walls of the workpiece a communicating radial passage, annular inner passage and annular outer fluid flow passage; discharging a high pressure fluid from the inner end of said nozzle against the central portion of the interior surface of the bottom wall of the workpiece to effect a high velocity radial outward flow of said fluid across the interior bottom surface thereof through said radial passage and sequentially into and through said annular inner passage and into and through said annular outer passage and beyond the closed end of the workpiece, deflecting the fluid flow upon emergence from the annular outer passage in impinging relationship against the exterior surface of the bottom wall of the workpiece and in intimate contact therewith, and thereafter draining the treating fluid from the chamber.

2. The method as defined in claim 1, including the further step of recovering the fluid drained from said chamber and recycling the recovered said fluid to said nozzle for reuse.

3. The method as defined in claim 1, including the further steps of stopping the flow of fluid discharged from said nozzle after a preselected time period, purging said radial passage, said annular inner passage and said annular outer passage with a high pressure flow of air and thereafter discharging a second high pressure fluid from said nozzle effecting a plural treatment of the surfaces of the workpiece.

4. The method as defined in claim 3, where the first fluid and said second fluid are treating liquids and including the further step of discharging additional high pressure air through said nozzle at the completion of the discharge of said second fluid for a period of time to effect a substantially complete drying of residual liquid on the surfaces of the workpiece.

* * * * *